US010431893B1

(12) United States Patent
Sethi et al.

(10) Patent No.: US 10,431,893 B1
(45) Date of Patent: Oct. 1, 2019

(54) OMNIDIRECTIONAL MULTIBAND ANTENNA

(71) Applicant: KING SAUD UNIVERSITY, Riyadh (SA)

(72) Inventors: Waleed Tariq Sethi, Riyadh (SA); Khaled Issa, Riyadh (SA); Muhammad Ahmed Ashraf, Riyadh (SA); Habib Fathallah, Soukra (TN); Saleh Alshebeili, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/237,623

(22) Filed: Dec. 31, 2018

(51) Int. Cl.
*H01Q 13/02* (2006.01)
*H01Q 5/55* (2015.01)
*H01Q 13/06* (2006.01)

(52) U.S. Cl.
CPC ..... *H01Q 13/0208* (2013.01); *H01Q 5/55* (2015.01); *H01Q 13/0258* (2013.01); *H01Q 13/065* (2013.01); *H01Q 13/0291* (2013.01)

(58) Field of Classification Search
CPC .. H01Q 13/02–13/06; H01Q 5/55; H01Q 9/28
USPC ..... 343/773–775
See application file for complete search history.

(56) References Cited

U.S. PATENT DOCUMENTS 2,936,453 A 5/1960 Coleman
3,401,387 A 9/1968 Milligan et al.
4,608,572 A 8/1986 Blakney et al.
6,268,834 B1 7/2001 Josypenko
6,919,855 B2 7/2005 Hills
7,701,396 B2 4/2010 Cohen
D623,633 S 9/2010 Bliss et al.
7,973,732 B2 7/2011 Cohen
D713,392 S 9/2014 Podduturi
8,976,069 B2 3/2015 Puente Baliarda et al.
2006/0012528 A1 1/2006 Hoshi et al.
2006/0250315 A1 11/2006 Parsche
2006/0284779 A1* 12/2006 Parsche ..... H01Q 9/28 343/773
2010/0194646 A1 8/2010 Cohen
2012/0068903 A1 3/2012 Thevenard et al.
2015/0280317 A1* 10/2015 Morin ..... H01Q 9/28 343/795

* cited by examiner

*Primary Examiner* — Dameon E Levi
*Assistant Examiner* — Hasan Z Islam
(74) *Attorney, Agent, or Firm* — Richard C. Litman

(57) ABSTRACT

The omnidirectional multiband antenna is a variant on a monocone antenna, particularly including a corrugated extending surface for lowering the low frequency cutoff of the monocone antenna. The omnidirectional multiband antenna includes an electrically conductive conical surface, having a vertex end and a base end, and at least one electrically conductive annular member mounted on the base end. The at least one electrically conductive annular member is formed from a plurality of stacked segments and has a corrugated exterior surface. The vertex end of the electrically conductive conical surface is positioned adjacent to, and spaced apart from, a first surface of a ground plane plate. A plurality of cylindrical rods is provided, a first end of each rod being secured to the at least one electrically conductive annular member, and a second end of each rod being mounted on the first surface of the ground plane plate.

19 Claims, 8 Drawing Sheets

OMNIDIRECTIONAL MULTIBAND ANTENNA

BACKGROUND

1. Field

The disclosure of the present patent application relates to multiband antennas, and particularly to an omnidirectional multiband antenna, especially for indoor distributed systems and wireless application in Global Mobile System (GSM) and Wireless Local Area Network (WLAN) applications.

2. Description of the Related Art

FIG. 3 shows a conventional prior art monocone antenna 100, which is formed from a conical surface 114 defined by a vertex end 116 and a base end 118, the base end 118 having a cylindrical surface 112 extending therefrom. The cylindrical surface 112 extends the length of the conical surface 114 for the purpose of lowering its low frequency cutoff. The vertex end 116 is positioned adjacent a ground plane plate 120. For example, the ground plane plate 120 may be part of the skin of an aircraft to which the monocone antenna 100 is mounted. A center conductor 122 of a coaxial cable 124 is connected to the vertex end 116 to feed the antenna. The outer conductor 126 of the coaxial cable 124 is connected to the ground plane 120. The vertex end 116 is adjacent to, but spaced apart from, the ground plane plate 120.

The antenna pattern of the monocone antenna 100 is substantially omnidirectional on the side of the ground plane plate 120 facing the conical surface 114. The functionality of monocone antenna 100 is limited with regard to diverse usage, since the height and the cone angle of the monocone define the low frequency cutoff, i.e., by having a fixed construction with a fixed geometry, the monocone antenna 100 has a predefined set low frequency cutoff. Thus, an omnidirectional multiband antenna solving the aforementioned problems is desired.

SUMMARY

The omnidirectional multiband antenna is a variant on a monocone antenna, particularly including a corrugated or accordion-like extending surface for lowering the low frequency cutoff of the monocone antenna. The omnidirectional multiband antenna includes an electrically conductive conical surface having a vertex end and a base end, and at least one electrically conductive annular member mounted on the base end. The at least one electrically conductive annular member is formed from a plurality of stacked segments and has a corrugated or accordion-like exterior surface. The vertex end of the electrically conductive conical surface is positioned adjacent to, and spaced apart from, a first surface of a ground plane plate.

A plurality of cylindrical rods are provided, such that a first end of each rod is secured to the at least one electrically conductive annular member, and a second end of each rod is mounted on the first surface of the ground plane plate. A center conductor of a coaxial cable is in electrical communication with the vertex end of the electrically conductive conical surface, and an outer conductor of the coaxial cable is in electrical communication with the ground plane plate.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
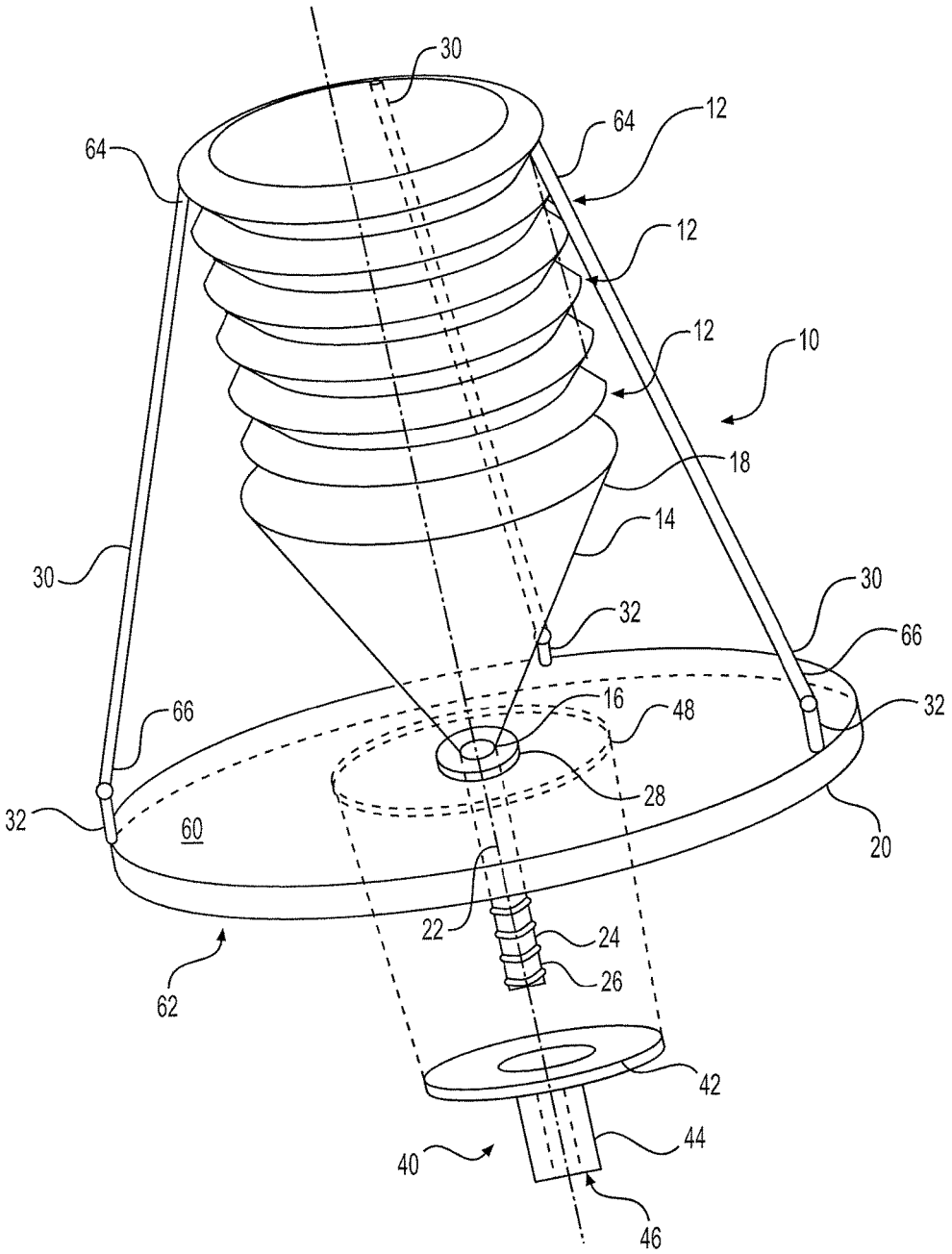
FIG. 1 is a perspective view of an omnidirectional multiband antenna.
Figure 2A:
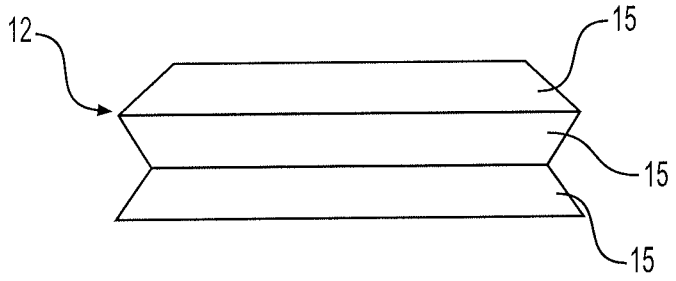
FIG. 2A is a side view of an electrically conductive annular member of the omnidirectional multiband antenna.
Figure 3:
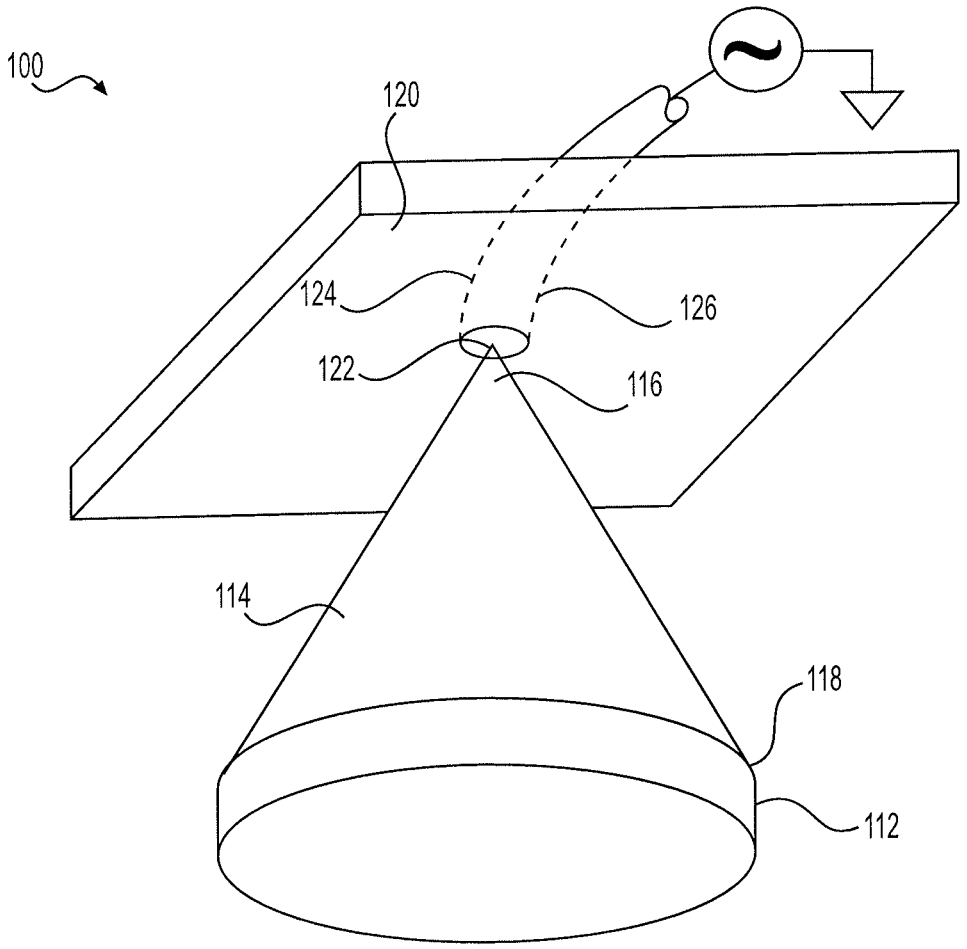
FIG. 3 (PRIOR ART)
FIG. 3 is a perspective view of a conventional prior art monocone antenna.

The omnidirectional multiband antenna 10 is a variant on a monocone antenna, such as that described above with respect to FIG. 3. The omnidirectional multiband antenna 10 includes a corrugated or accordion-like extending surface for lowering the low frequency cutoff of the monocone antenna. As shown in FIG. 1, the omnidirectional multiband antenna 10 includes an electrically conductive conical surface 14, having a vertex end 16 and a base end 18, and at least one electrically conductive annular member 12 mounted on the base end 18. The at least one electrically conductive annular member 12 is formed from a plurality of stacked segments 15 and has a corrugated or accordion-like exterior surface, as best seen in FIG. 2A.

The vertex end 16 of the electrically conductive conical surface 14 is positioned adjacent to, and spaced apart from, a first surface 60 of a ground plane plate 20. As shown, an annular, electrically non-conductive spacer 28 may be positioned between the vertex end 16 of the electrically conductive conical surface 14 and the first surface 60 of the ground plane plate 20. In FIG. 1, the ground plane plate 20 is shown as being circular with an annular rim. However, it should be understood that the circular ground plane plate 20 is shown for exemplary purposes only and may have any suitable configuration and relative dimensions.

In order to vary the low frequency cutoff, the omnidirectional multiband antenna 10 may be constructed with any desired number of electrically conductive annular members 12. In the exemplary antenna 10 of FIG. 1, four such electrically conductive annular members 12 are shown, axially stacked, one on top of the other, although it should be understood that this number of such electrically conductive annular members 12 is shown solely for exemplary purposes.

Figure 2B:
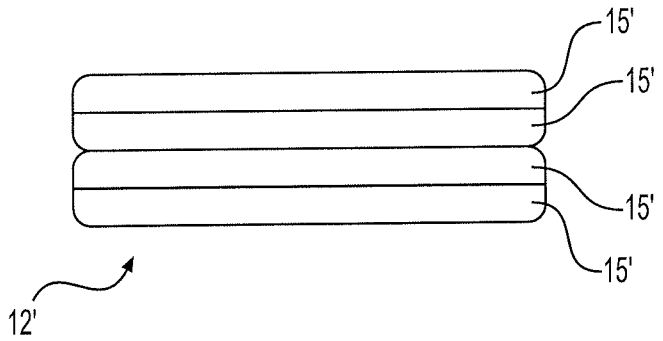
FIG. 2B is a side view of an alternative embodiment of the electrically conductive annular member of the omnidirectional multiband antenna.
Figure 2C:
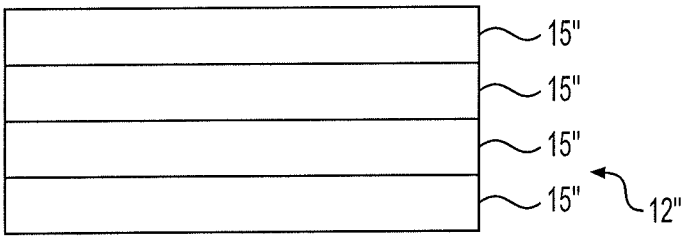
FIG. 2C is a side view of another alternative embodiment of the electrically conductive annular member of the omnidirectional multiband antenna.
Figure 2D:
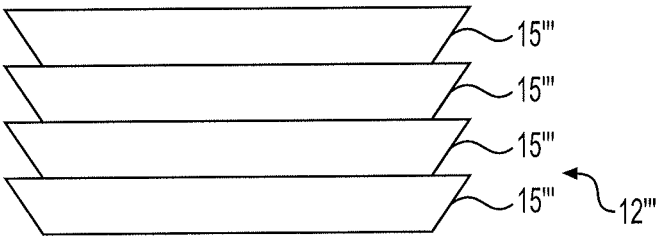
FIG. 2D is a side view of still another alternative embodiment of the electrically conductive annular member of the omnidirectional multiband antenna.

Further, it should be understood that the stacked segments 15 forming each electrically conductive annular member 12 may have any suitable configuration for defining the corrugated or accordion-like configuration of the exterior surface. In the annular member 12 of FIGS. 1 and 2A, adjacent ones of stacked segments 15 are symmetrical with respect to one another about a circumferential plane, and each have a trapezoidal cross section. In FIG. 2B, the electrically conductive annular member 12' is shown formed from stacked segments 15', where adjacent ones of stacked segments 15' are again symmetrical with respect to one another about a circumferential plane, but each has a substantially rectangular cross section, such that a pair of diametrically opposed corners thereof are rounded. In FIG. 2C, the electrically conductive annular member 12" is shown formed from stacked segments 15", where each segment 15" is rectangular, thus providing an extension similar to that of cylindrical surface 112 of the prior art monocone antenna 100 of FIG. 3. In FIG. 2D, the electrically conductive annular member 12''' is shown formed from stacked segments 15''', where adjacent ones of the stacked segments 15''' are identically oriented with respect to one another about the circumferential plane, and each segment 15''' is trapezoidal.

It should be understood that the electrically conductive conical surface 14, the at least one electrically conductive annular member 12, and ground plane plate 20 may be formed from any suitable type of electrically conductive material, such as copper, aluminum or brass sheet material, as is well known in the field of antenna construction. Further, it should be understood that the electrically conductive conical surface 14, the at least one electrically conductive annular member 12, and ground plane plate 20 may be enclosed by a wire cage and/or may be formed from wire mesh, as is also well known in the field of antenna construction.

A plurality of conductive cylindrical rods 30 are provided, such that a first end 64 of each rod 30 is secured to the at least one electrically conductive annular member 12, and a second end 66 of each rod 30 is mounted on the first surface 60 of the ground plane plate 20. As shown, a plurality of conductive spacers 32 may be secured to the first surface 60 of the ground plane plate 20, and the second end 66 of each rod 30 may be secured to a corresponding one of the spacers 32. The first end 64 of each rod 30 is secured to the topmost one of the plurality of axially stacked electrically conductive annular members 12, as shown. In FIG. 1, three such rods 30 (and three corresponding mounting rods 32) are shown, spaced 120° apart. However, it should be understood that the three rods 30 are shown for exemplary purposes only, and that any suitable number of rods 30 may be used.

A center conductor 22 of a coaxial cable 24 is in electrical communication with the vertex end 16 of the electrically conductive conical surface 14, and an outer conductor 26 of the coaxial cable 24 is in electrical communication with the ground plane plate 20. As shown in FIG. 1, a plastic cable fixing member 40 may be provided in the form of a hollow tubular portion 44 with an annular flange 42. The coaxial cable 24 extends through the central passage 46 of the hollow tubular portion 44 for securing the coaxial cable 24. A recess 48 may be formed in the second surface 62 of the ground plane plate 20 for receiving the annular flange 42. Alternatively, the cable fixing member 40 may be used as a mounting structure, such that a mounting surface, such as the wall of an airplane or the like, is clamped between the annular flange 42 and the second surface 62.

The electrically conductive conical surface 14, the at least one, electrically conductive annular member 12 and ground plane plate 20 may each be manufactured, e.g., from aluminum sheeting with a thickness of 0.1 cm, the base end 18 of the conical surface 14 having a diameter of about 8 cm and a height of about 6 cm. The ground plane plate 20 may be circular, as described above, having a diameter of about 15 cm. Each segment 14 can have a maximum outer diameter of about 10 cm, and each electrically conductive annular member 12 may have a height of about 1 cm.

Figure 4:
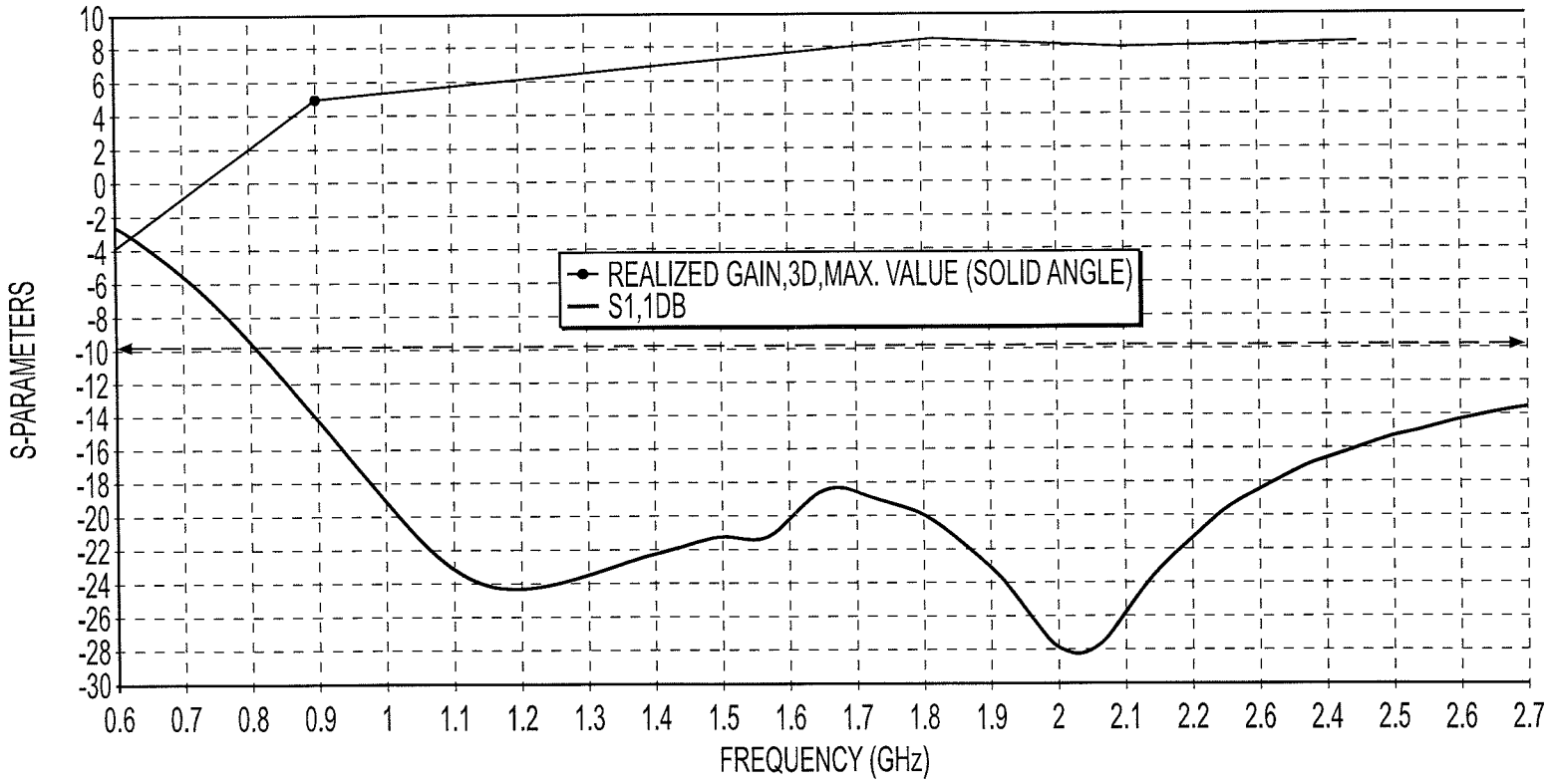
FIG. 4 is a graph showing the S-parameters and gain of the omnidirectional multiband antenna of FIG. 1.
Figure 5:
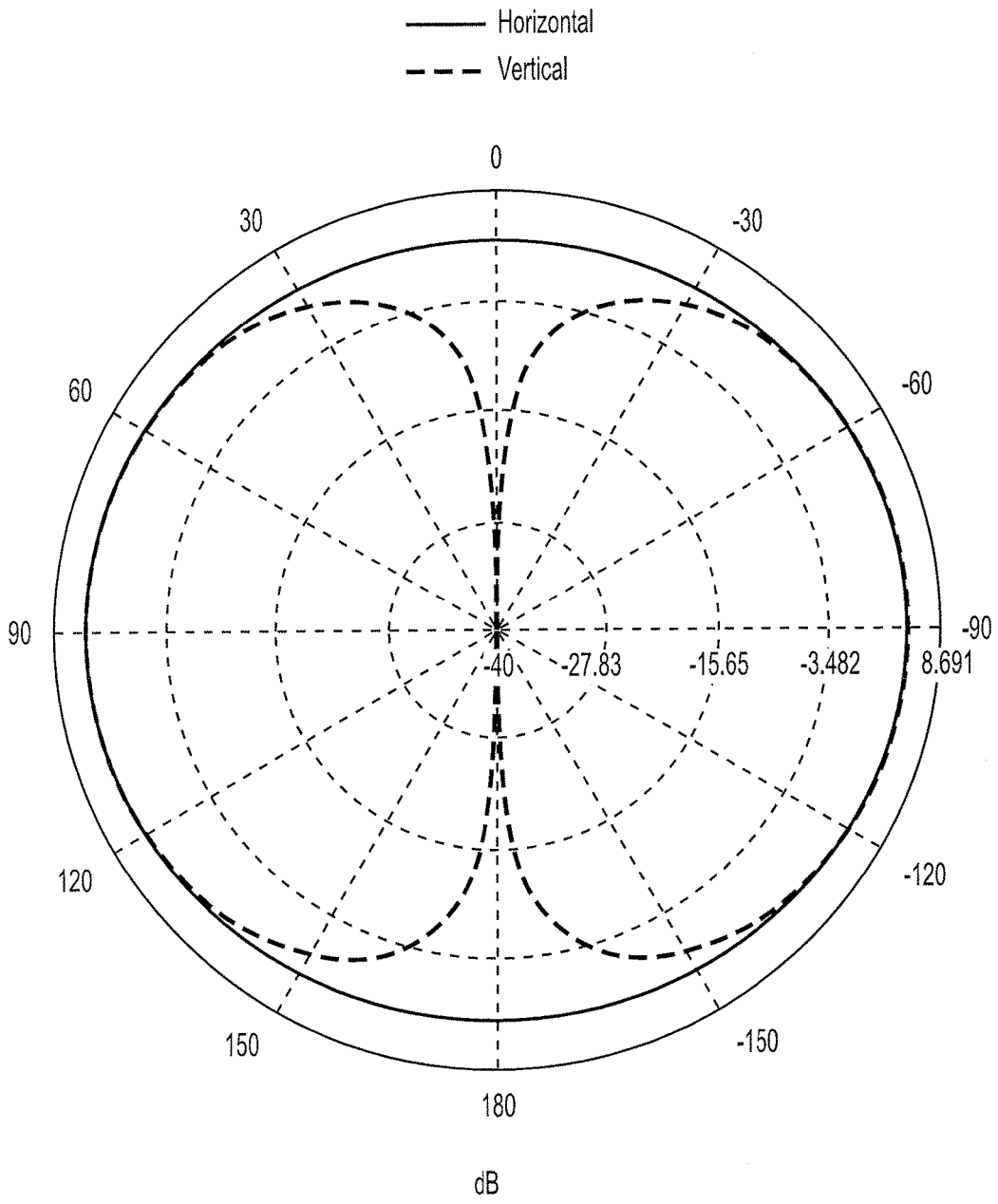
FIG. 5 is a two-dimensional polar plot of the radiation pattern of the omnidirectional multiband antenna in the 900 MHz band.
Figure 6:
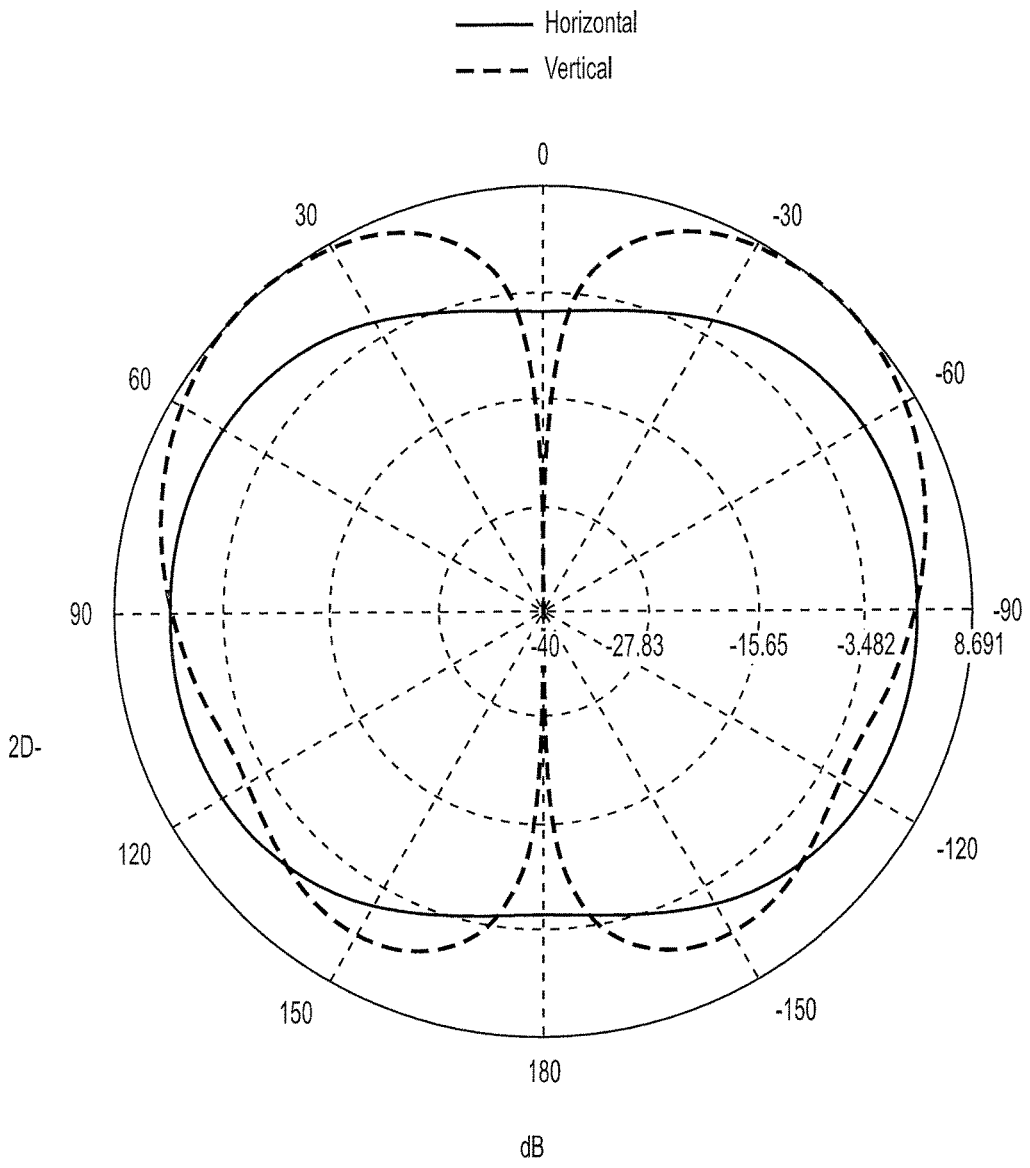
FIG. 6 is a two-dimensional polar plot of the radiation pattern of the omnidirectional multiband antenna in the 1800 MHz band.
Figure 7:
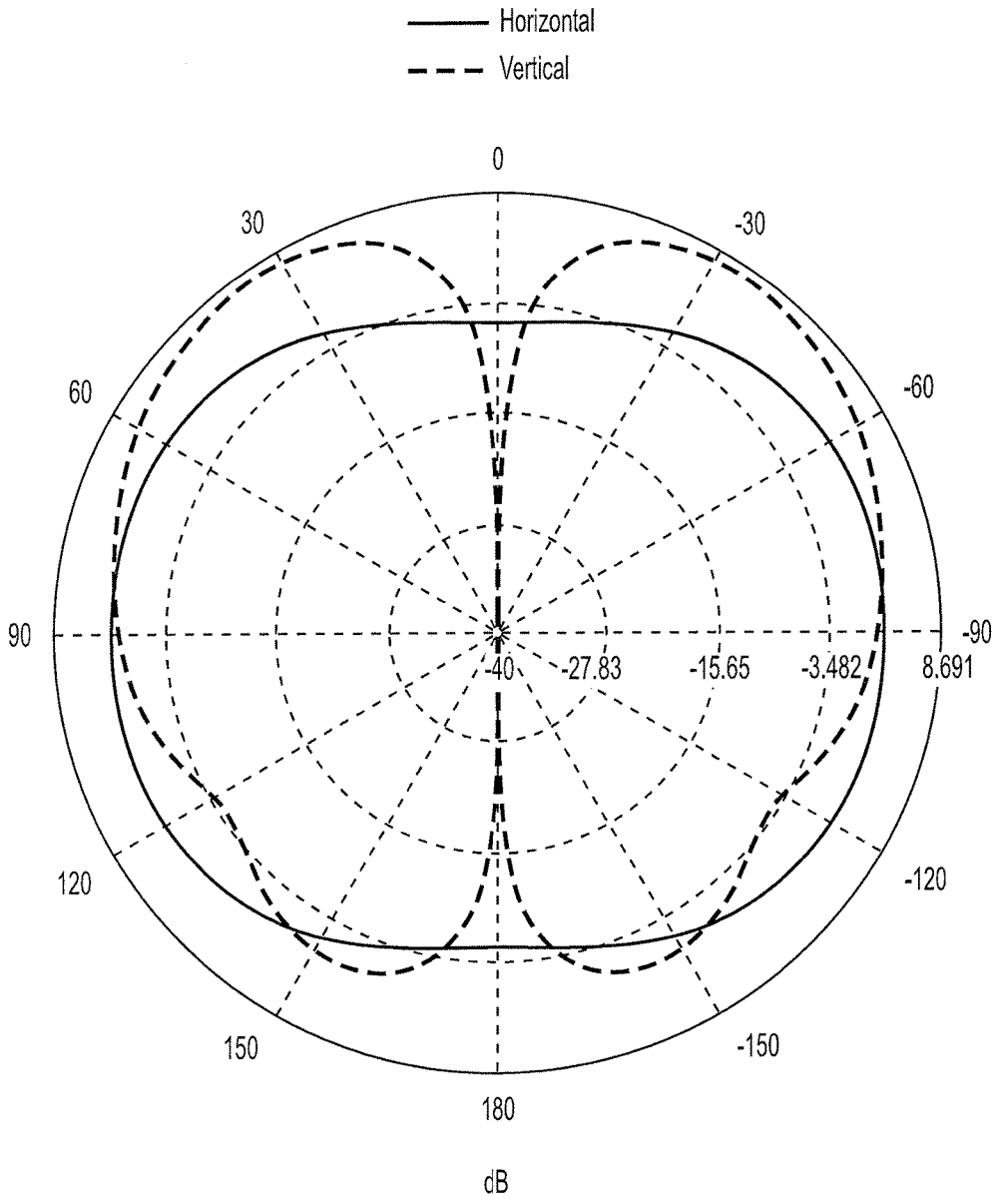
FIG. 7 is a two-dimensional polar plot of the radiation pattern of the omnidirectional multiband antenna in the 2100 MHz band.

FIG. 4 shows the S-parameters and gain for an omnidirectional multiband antenna 10 constructed using the above exemplary parameters. As shown, the S-parameters are below −10 dB, ranging from 750 MHz to 3000 MHz, which indicates an acceptably efficient operation within this wideband frequency band when used with a 50Ω system. Further, the gain values start from almost 5 dB at lower frequency bands, and 8 dB at higher frequency bands. The omnidirectional multiband antenna 10 may also have horizontal and vertical polarization radiation patterns covering all of the 360° region at 900 MHz, 1800 MHz and 2100 MHz, as respectively shown in FIGS. 5, 6 and 7. It can be seen that each radiation pattern is close to a corresponding optimal radiation pattern, and there is no obvious radiating blind area.

It is to be understood that the omnidirectional multiband antenna is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An omnidirectional multiband antenna, comprising:

an electrically conductive conical surface having a vertex end and a base end;

at least one electrically conductive annular member mounted on the base end of the electrically conductive conical surface, the at least one electrically conductive annular member having a plurality of stacked segments and a corrugated exterior surface;

a ground plane plate having opposed first and second surfaces, the vertex end of the electrically conductive conical surface being positioned adjacent to, and spaced apart from, the first surface of the ground plane plate;

a plurality of cylindrical rods, each of the rods having opposed first and second ends, the first end of each of the rods being secured to the at least one electrically conductive annular member, the second end of each of the rods being mounted on the first surface of the ground plane plate; and a coaxial cable having a center conductor and an outer conductor, the center conductor being in electrical communication with the vertex end of the electrically conductive conical surface, and the outer conductor being in electrical communication with the ground plane plate.

2. The omnidirectional multiband antenna as recited in claim 1, further comprising an annular, electrically non-conductive spacer positioned between the vertex end of the electrically conductive conical surface and the first surface of the ground plane plate.

3. The omnidirectional multiband antenna as recited in claim 1, further comprising a plurality of spacers secured to the first surface of the ground plane plate, the second end of each said cylindrical rod being secured to a corresponding one of the spacers.

4. The omnidirectional multiband antenna as recited in claim 1, wherein the at least one electrically conductive annular member comprises a plurality of axially stacked electrically conductive annular members, the first end of each said cylindrical rod being secured to a topmost one of the plurality of axially stacked electrically conductive annular members.

5. The omnidirectional multiband antenna as recited in claim 1, wherein adjacent ones of the plurality of stacked segments are symmetrical with respect to one another about a circumferential plane.

6. The omnidirectional multiband antenna as recited in claim 5, wherein each one of said stacked segments is trapezoidal in cross section.

7. The omnidirectional multiband antenna as recited in claim 5, wherein each one of said stacked segments is substantially rectangular in cross section and diametrically opposed corners of said segments are rounded.

8. The omnidirectional multiband antenna as recited in claim 1, wherein adjacent ones of the plurality of stacked segments are identically oriented with respect to one another about a circumferential plane.

9. The omnidirectional multiband antenna as recited in claim 8, wherein each one of said stacked segments is trapezoidal in cross section.

10. The omnidirectional multiband antenna as recited in claim 1, further comprising a cable fixing member having a hollow tubular portion and an annular flange.

11. The omnidirectional multiband antenna as recited in claim 10, wherein the second surface of said ground plane plate has a recess formed therein for receiving the annular flange of the cable fixing member.

12. An omnidirectional multiband antenna, comprising:

an electrically conductive conical surface having a vertex end and a base end;

at least one electrically conductive annular member mounted on the base end of the electrically conductive conical surface, the at least one electrically conductive annular member having a plurality of stacked segments and a corrugated exterior surface;

a ground plane plate having opposed first and second surfaces, the vertex end of the electrically conductive conical surface being positioned adjacent to, and spaced apart from, the first surface of the ground plane plate;

a plurality of cylindrical rods, each having opposed first and second ends, the first end of each of the rods being secured to the at least one electrically conductive annular member, the second end of each of the rods being mounted on the first surface of the ground plane plate;

a coaxial cable having a center conductor and an outer conductor, the center conductor being in electrical communication with the vertex end of the electrically conductive conical surface, and the outer conductor being in electrical communication with the ground plane plate; and a cable fixing member having a hollow tubular portion and an annular flange, the second surface of the ground plane plate having a recess formed therein for receiving the annular flange of the cable fixing member.

13. The omnidirectional multiband antenna as recited in claim 12, further comprising an annular, electrically non-conductive spacer positioned between the vertex end of the electrically conductive conical surface and the first surface of the ground plane plate.

14. The omnidirectional multiband antenna as recited in claim 12, further comprising a plurality of spacers secured to the first surface of the ground plane plate, the second end of each said cylindrical rod being secured to a corresponding one of the cylindrical rods.

15. The omnidirectional multiband antenna as recited in claim 12, wherein the at least one electrically conductive annular member comprises a plurality of axially stacked electrically conductive annular members, the first end of each said cylindrical rod being secured to a topmost one of the plurality of axially stacked electrically conductive annular members.

16. The omnidirectional multiband antenna as recited in claim 12, wherein adjacent ones of the plurality of stacked segments are symmetrical with respect to one another about a circumferential plane.

17. The omnidirectional multiband antenna as recited in claim 16, wherein each one of said stacked segments is trapezoidal in cross section.

18. The omnidirectional multiband antenna as recited in claim 16, wherein each one of said stacked segments is substantially rectangular in cross section and diametrically opposed corners thereof are rounded.

19. The omnidirectional multiband antenna as recited in claim 12, wherein adjacent ones of the plurality of stacked segments are identically oriented with respect to one another about a circumferential plane.

* * * * *